US011230459B2

(12) United States Patent
Illedits et al.

(10) Patent No.: US 11,230,459 B2
(45) Date of Patent: Jan. 25, 2022

(54) BELT-DRIVEN ESCALATOR

(71) Applicant: Otis Elevator Company, Farmington, CT (US)

(72) Inventors: Thomas Illedits, Neufeld an der Leitha (AT); Alexander Turek, Münchendorf (AT)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 16/951,044

(22) Filed: Nov. 18, 2020

(65) Prior Publication Data

US 2021/0403291 A1 Dec. 30, 2021

(51) Int. Cl.

| | |
|---|---|
| ***B66B 23/02*** | (2006.01) |
| ***B66B 23/12*** | (2006.01) |
| ***B66B 21/04*** | (2006.01) |
| ***B66B 23/14*** | (2006.01) |

(52) U.S. Cl.

CPC ..... *B66B 23/022* (2013.01); *B66B 21/04* (2013.01); *B66B 23/12* (2013.01); *B66B 23/145* (2013.01)

(58) Field of Classification Search

CPC ... B66B 23/026; B66B 23/028; B66B 23/022; B66B 21/04; B66B 23/12

USPC ..... 198/330

See application file for complete search history.

(56) References Cited

U.S. PATENT DOCUMENTS

| | | | | |
|---|---|---|---|---|
| 972,475 | A | 10/1910 | Seeberger | |
| 3,366,217 | A * | 1/1968 | Tosato | B65G 23/14 198/833 |
| 6,540,060 | B1 * | 4/2003 | Fargo | B66B 23/02 198/326 |
| 2006/0137960 | A1 * | 6/2006 | Fargo | B66B 23/028 198/330 |
| 2007/0137980 | A1 * | 6/2007 | Meyer | B66B 23/024 198/327 |
| 2008/0053788 | A1 * | 3/2008 | Ishikawa | B66B 23/02 198/330 |
| 2009/0120762 | A1 * | 5/2009 | Gonzalez Alemany | B66B 23/028 198/330 |

(Continued)

FOREIGN PATENT DOCUMENTS

| | | |
|---|---|---|
| EP | 1440031 B1 | 9/2013 |
| JP | H01247312 A | 10/1989 |

(Continued)

OTHER PUBLICATIONS

European Search Report for Application No. 20182727.6; dated Mar. 3, 2021; 8 Pages.

*Primary Examiner* — James R Bidwell
(74) *Attorney, Agent, or Firm* — Cantor Colburn LLP

(57) ABSTRACT

A belt-driven escalator (2) includes a plurality of escalator steps (4) arranged to travel along an inclined conveyance path (101), a drive belt (10) connected to the plurality of escalator steps (4), a drive system (24) arranged to drive the drive belt (10) so as to propel the plurality of escalator steps (4) along the inclined conveyance path (101); and a belt support structure (22). The belt support structure (22) includes a plurality of support wheels (206) and a support belt (212) extending over the plurality of support wheels (206). The support belt (212) is arranged to provide support to the plurality of escalator steps (4) via the drive belt (10).

14 Claims, 18 Drawing Sheets

(56) References Cited

U.S. PATENT DOCUMENTS

2009/0139830 A1* 6/2009 Gonzalez Alemany .....
B66B 23/028
198/321

FOREIGN PATENT DOCUMENTS

WO 2004071928 A1 8/2004
WO 2005051811 A1 6/2005

* cited by examiner

BELT-DRIVEN ESCALATOR

FOREIGN PRIORITY

This application claims priority to European Patent Application No. 20182722.7, filed Jun. 26, 20202, and all the benefits accruing therefrom under 35 U.S.C. § 119, the contents of which in its entirety are herein incorporated by reference.

TECHNICAL FIELD

The present disclosure relates to belt driven escalators.

BACKGROUND

Conventional escalators comprise a set of steps on which passengers stand that are propelled by a drive system to convey the passengers from one place to another (e.g. between floors of a building). The steps are typically connected to an endless step chain made up of multiple chain links that passes over a drive sprocket. The drive sprocket is rotated by the drive system (typically via a drive chain), driving the step chain to pull the steps along (e.g. up or down inclined guide tracks). Each step is carried in a continuous loop by the step chain, carrying passengers from one end of the escalator to the other (e.g. up an incline), before looping back.

Over the lifetime of the escalator, the pins and sockets that connect links of the step chain can become worn, leading to a potentially dangerous elongation of the step chain. It is, therefore, desirable to utilise as few links as possible in a step chain, to reduce the magnitude of wear-induced elongation. However, reducing the number of links reduces ride comfort and requires a larger sprocket to drive the step chain. A larger drive sprocket requires a higher torque from the drive system and takes up additional space, increasing the footprint of the escalator.

Belt-driven escalators are also known in which the step chain is replaced by a drive belt, typically a toothed drive belt, with the escalator steps attached to and pulled by the belt.

SUMMARY

According to a first aspect of the present disclosure there is provided a belt-driven escalator comprising: a plurality of escalator steps arranged to travel along an inclined conveyance path; a drive belt connected to the plurality of escalator steps; a drive system arranged to drive the drive belt so as to propel the plurality of escalator steps along the inclined conveyance path; and a belt support structure comprising a plurality of support wheels and a support belt extending over the plurality of support wheels, wherein the support belt is arranged to provide support to the plurality of escalator steps via the drive belt.

Because the support belt of the belt support structure provides support to the escalator steps (i.e. support with a component in a direction perpendicular to the direction of travel of the drive belt) via the drive belt, the amount of direct step support that is provided to the steps through a step track or support track (e.g. through support rollers of the steps travelling along support tracks) may be reduced or even eliminated in some regions of the conveyance path. Supporting the steps via a support belt and the drive belt may also improve the ride comfort for passengers of the escalator compared to supporting the drive belt directly with belt wheels, because the support belt can contact (and thus support) the drive belt along a continuous length and thus provide a greater contact area with the drive belt. This can mitigate sudden changes in direction of the drive belt that occur when the belt is supported by several separate components. This may also reduce regions of high stress in the drive belt that can be produced when belt wheels are used to support the drive belt directly, increasing the drive belt's service lifetime.

Furthermore, the use of a support belt may allow the support wheels to have a radius smaller than equivalent belt wheels (i.e. equivalent belt wheels with no support belt) because they do not interact directly with the drive belt (which, e.g., may be toothed and thus less suited to support from small belt wheels). The support wheels can thus be positioned closer together than the equivalent belt wheels, providing more even support to the support belt and consequently further smoothing the path followed by the drive belt as it is supported, reducing stresses and improving passenger comfort.

In some examples the support belt comprises an endless belt that extends in a loop around the plurality of support wheels. Some of the support wheels may be arranged to tension the support belt. The support wheels preferably allow the support belt to move in the direction of travel of the drive belt with little resistance (i.e. so that the support belt can move with the drive belt as it provides support thereto).

In some examples the support belt provides curved support to the drive belt. A support belt is particularly suitable for providing curved support as it can provide a continuous contact area that follows a smooth curve, thus mitigating sudden changes in direction in the drive belt (e.g. between points of contact with a plurality of belt wheels arranged in a curve), improving passenger comfort and reducing drive belt wear. In some such examples, the plurality of support wheels over which the support belt extends may comprise at least three coplanar support wheels arranged in a curve. Support wheels are considered to be coplanar when they all provide support and rotate within a common plane, i.e. in which the drive belt also extends, i.e. with their axes of rotation all being perpendicular to the common plane. The curve may comprise an arc of a circle. The plurality of coplanar support wheels may be arranged such that the support belt replicates curved support that would be provided by a single belt wheel with a large radius supporting the belt directly. For example, the belt support structure may be arranged to provide curved support along a curve comprising a radius of curvature of 0.5 m or more (e.g. of approximately 1 m or more). In some examples the plurality of support wheels may comprise at least five coplanar support wheels. This allows more accurate representation of a desired curve or path and provides a smoother ride quality as the change of angle experienced at any given support wheel can be reduced.

The drive belt may be connected to each step at a single point, e.g. coincident with a direct support member such as a support roller. With no belt support structure, the drive belt extends in substantially straight lines between these connection points. The drive belt may extend the entire length of the escalator (e.g. as an endless belt), carrying the steps in a continuous loop from one end of the escalator to the other before looping back. In curved regions of the belt path there will be sharp changes in the direction of the drive belt around each connection point that can lead to localised increased stresses in the belt. However, when the support belt supports the escalator steps via the drive belt, as in examples of the present disclosure, these sharp changes in direction may be mitigated by the support belt providing additional regions of drive belt contact, thereby reducing stresses on the drive belt and increasing its service life.

The escalator may comprise a step track along which the steps are arranged to travel during passenger conveyance. The step track may define the conveyance path. Each step may comprise a step roller arranged to roll on the step track. Optionally, the escalator comprises two parallel step tracks and each step comprises two corresponding step rollers one on each of the opposite sides of the step. Using two step tracks may help to keep the steps level during passenger conveyance.

The escalator may comprise a support track (different to the step track) by which each step may be directly supported (e.g. via a support component of the step such as a roller or a bushing) as they travel along the conveyance path. The support track may extend along the entire conveyance path and may extend parallel to the step track in at least some regions (e.g. in an inclined region).

The step track, the support track and each step (e.g. a step roller and a support roller of each step) may be arranged such that each step (e.g. a tread surface of each step) is oriented horizontally throughout passenger conveyance along the conveyance path to ensure comfort and safety. In some examples therefore the step tracks and support tracks may diverge (i.e. not extend parallel) in at least some regions of the conveyance path. For example, the support track and the step track may diverge in a transition region, e.g. where the steps transition between an inclined path and a horizontal path. In some examples, the step roller may be positioned in an upper region of the step (e.g. at the top of the step), and the first support component may be positioned in a lower region of the step (e.g. at the bottom of the step).

The drive belt may be connected to the steps such that it passes through an axis of rotation of a support roller (e.g. the axis may pass halfway through a thickness of the drive belt). Arranging the support roller such that its rotation axis is near to or aligned with the centre of drive force may reduce or even eliminate the application of off-axis forces (i.e. a moment) to the support roller.

The belt support structure may be arranged to at least partially unload the step track and/or support track (and any corresponding step rollers and/or support rollers) at at least one point on the conveyance path (e.g. over a particular region of the conveyance path). In the case of partial unloading of the step track and/or support track, the load may be shared between the track(s) and the belt support structure. The belt support structure may be arranged to fully unload the tracks/rollers by lifting the steps entirely away from the step track(s) and/or support track(s), so that the step rollers and/or support rollers do not make contact with the step track(s) and/or support track(s). It will be appreciated that in such examples portions of the step track(s) and or support track(s) may be omitted in order to save materials and costs where they do not provide any support function owing to the support being provided instead by the belt support structure.

The conveyance path may comprise at least one non-inclined region (i.e. a region in which the steps travel substantially parallel to the ground). For example, the conveyance path may comprise a non-inclined landing region at one or both ends of the conveyance path to facilitate passenger embarkation or disembarkation from the escalator. In some such examples, the conveyance path may comprise a transition region between the inclined region and the landing region in which the steps transition from travelling at an incline to travelling parallel to the ground in the non-inclined landing region. In such examples, the step track and/or the support track may comprise an inclined section, a non-inclined landing section and a curved transition section corresponding to the transition region to facilitate a smooth transition between inclined and horizontal travel of the steps.

In such a transition region, the drive belt undergoes a change in direction between successive steps. In the upper transition region this results in an increased load on each step (e.g. through the step roller and/or support roller) due to the tension forces exerted on each step from the drive belt having a component pointing into the curve of the transition region (i.e. urging the steps into the step tracks and/or support tracks). Therefore, the belt support structure may be arranged to provide support to the steps in an upper transition region.

Without a belt support structure, providing adequate support to the steps in the upper transition region requires increased strength in either the step track(s) and/or support track(s). If this strength (usually provided by thicker material) is provided throughout the length of the tracks then the tracks will be unnecessarily strong elsewhere (e.g. in an inclined region where the belt does not change direction and where the step may not require as much support). The step track(s) and/or support track(s) could have a complex structure to provide varying amounts of strength in different regions (e.g. increased strength in the transition region), but this adds to manufacturing complexity and expense. In addition, without a belt support structure, the component(s) by which the steps contact the step track(s) and/or support track(s) (e.g. step rollers/support rollers) need to be built to handle the larger forces arising in the transition region, despite only actually experiencing this force over a small section of the entire conveyance path. Therefore, arranging the belt support structure to provide support to the steps in an upper transition region allows the step track(s) and/or support track(s), and the step rollers and/or support rollers to be simplified and optimised to provide only the amount of support required in other sections of the conveyance path, with the support "shortfall" in the upper transition region being made up by the belt support structure. This may reduce costs, weight and manufacturing complexity. For example, by providing extra support where required with the belt support structure, the step track(s) and/or support track(s) may be made thinner, saving material and cost.

In examples where the belt support structure is arranged to provide support in a curved upper transition region, the belt support structure may be arranged to provide similarly curved support to the drive belt. In such examples, the curve of the curved support may be chosen to be substantially the same as the curve of a transition region, to provide consistent support to the steps as they travel through the transition region. For example, the transition region of the conveyance path may comprise a curve with a certain radius of curvature (e.g. an arc with a certain radius) and the plurality of coplanar support wheels may be arranged such that the support belt provides support to the drive belt along an at least approximately matching curve (e.g. an arc with approximately the same radius).

In some examples the drive belt may be toothed (i.e. the drive belt may comprise a plurality of teeth) and the drive system may comprise a drive sprocket arranged to engage with (the teeth of) the drive belt. The use of a toothed drive belt in conjunction with a drive sprocket may enable a high amount of drive force to be transmitted from a drive motor to the escalator steps. The use of teeth may also reduce or avoid slippage. The drive belt may comprise a substantially flat belt, i.e. with a width that is greater than its thickness (width being the dimension perpendicular to the direction of drive and parallel to the axis of rotation of the drive sprocket).

The belt support structure may comprise a frame to which the plurality of support wheels are mounted (e.g. via an axle and a bearing such as a ball bearing). Some or all of the plurality of support wheels may be mounted to the frame on only one side of the support belt (e.g. each of one or more support wheels may be connected to the frame via an axle running through the centre of rotation of the support wheel and secured to the frame on only one side, i.e. as a cantilever). In some examples, all of the support wheels are mounted to the frame by cantilever support on the same side of the support belt, to facilitate the removal and replacement of the support belt without needing to disassemble the frame (e.g. allowing in-situ belt replacement). However, in some other examples, some or all of the support wheels are mounted to the frame on either side of the support belt (e.g. via an axle secured to the frame on both sides of the support belt). This may provide increased support to the support wheels and thus to the support belt and drive belt. In such examples, some or all of the support wheels may be detachably mounted to the frame on at least one side of the support belt, so that the support belt may be removed and replaced without requiring the whole belt support structure to be removed from service. For example, the belt support structure may comprise one or more removable mounting structures via which one or more support wheels is mounted to the frame during operation, but which can be removed (e.g. by unscrewing one or more securing bolts) to allow for support belt replacement when needed.

One or more of the plurality of support wheels may be adjustably mounted to the frame, to allow the position and/or orientation of the support belt, or the tension in the support belt, to be adjusted. This may allow the belt support structure to be used in several different regions of an escalator and/or in different escalators.

The frame may be mounted to a truss of the escalator. Additionally or alternatively, the frame may be mounted to a building in which the escalator is located. The frame may be adjustably mounted to the truss and/or building (e.g. via one or more screw-adjustable mount points), to facilitate the use of the belt support structure in different regions of an escalator and/or in different escalators.

The support belt may comprise a polyurethane and/or rubber material, such as ethylene propylene rubber (e.g. EPDM). The support belt may comprise a flat belt (i.e. with a width that is greater than its thickness). The support belt may comprise a smooth upper surface arranged to contact and provide even support to the drive belt. This may be particularly useful for providing even support to a toothed drive belt, as a smooth engagement surface may reduce the prevalence of regions of increased stress in the drive belt (e.g. around the base of the teeth).

In some examples, the support belt comprises a lower surface in contact with the support wheels and comprising at least one longitudinal groove (e.g. a "v" shaped groove). In such examples, at least one of the support wheels over which the support belt extends may comprise a corresponding ridge arranged to engage with the groove to guide the support belt and keep it in the correct position. In some sets of examples, the support belt comprises a poly-v belt (i.e. a flat belt comprising several adjacent "v" shaped grooves). In such examples, at least one of the support wheels may comprise a corresponding plurality of ridges. Of course, in some examples, the support belt may comprise at least one longitudinal ridge (or a plurality of adjacent ridges) and at least one support wheel may comprise a corresponding groove (or a plurality of grooves) arranged to engage with the ridge(s).

The plurality of support wheels may be all be of the same or similar type (e.g. comprising the same or similar material(s) and/or having the same or similar dimensions). However, in some examples the plurality of support wheels may comprise two or more types of support wheels. For example, the belt support structure may comprise two terminal support wheels between which the support belt extends, along with one or more intermediate support wheels located between the two terminal support wheels. In such examples, the terminal support wheels may hold the belt in tension whilst the intermediate support wheels simply provide upwards support to the support belt. The terminal support wheels may have a larger radius than the intermediate support wheels, to increase the radius of curvature of, and thus reduce localised stresses on, the support belt as it passes around them. In examples featuring a grooved or poly-v support belt, one or more of the terminal support wheels may comprise a corresponding ridge or groove or plurality of ridges or grooves to help to guide the support belt. In some examples the belt support structure may comprise at least three, or even at least five intermediate support wheels.

The plurality of support wheels may comprise a plurality of coplanar support wheels. The plurality of support wheels may comprise adjacent support wheels. The plurality of support wheels may comprise some coplanar support wheels and some adjacent support wheels. For example, the plurality of support wheels may comprise two or more adjacent sets of coplanar support wheels to provide support over a greater width (perpendicular to the direction of travel of the support/drive belts).

The belt support structure may comprise a single support belt (e.g. supported by a single set of coplanar wheels or by adjacent wheels). However, in some examples the belt support structure comprises a plurality of adjacent support belts (e.g. all supported by a single set of coplanar wheels, by adjacent wheels, or a mixture of both). This may, for example, allow readily-available belts of a standard width to be used to support drive belts of several different widths. The escalator may comprise a corresponding plurality of adjacent drive belts, with each support belt arranged to support a drive belt. However, in some examples the plurality of adjacent support belts is arranged to support a single drive belt. Correspondingly, in some examples the escalator system may comprise a plurality of adjacent drive belts all supported by a single support belt.

The drive belt may comprise reinforcing longitudinal strands (e.g. comprising steel, stainless steel, carbon and/or aramid fibre). The reinforcing strands may be embedded in the polyurethane and/or rubber material of the drive belt.

Each step may comprise a tread surface on which passengers stand whilst they are conveyed. The tread surface may comprise an upper surface of the step (i.e. an upper surface whilst the step is carrying passengers—the steps may loop back in a different orientation). The tread surface may be substantially planar, although it may comprise a series of ridges or grooves extending perpendicular to the surface.

As mentioned above, to provide a safe and comfortable ride to passengers, the escalator may be arranged such that the tread surface of each step maintains a constant orientation (e.g. horizontal) throughout passenger conveyance. In some examples, this may require the orientation of the step to change relative to the drive belt during operation, for example as the steps transition from an inclined region of the escalator to a flat (i.e. horizontal) landing region of the escalator. In some examples, therefore, the drive belt is rotatably connected to each step (i.e. such that it can rotate about an axis perpendicular to the direction of drive but parallel to a tread surface). Connecting the belt such that it can rotate relative to each step enables the drive direction of the belt to change without changing the orientation of the step. For example, rotatably connecting the drive belt enables the steps to be driven along a curved transition region whilst the step's orientation remains constant relative to the ground (e.g. with a tread surface of the step remaining horizontal).

The escalator may comprise a single drive belt (e.g. connected to the steps at a point at or near to their middle (in a direction perpendicular to the direction of travel)). A single drive belt may comprise one unitary belt structure, but in some examples, a single drive belt may comprise two or more connected parallel sub-belts. In such examples, the support belt (or, in relevant examples, the plurality of support belts) may be arranged to support the plurality of escalator steps via one sub-belt, via some of the sub-belts, or via all the sub-belts.

In some examples the escalator may comprise a plurality of drive belts that are all separately connected to the plurality of steps and driven by the drive system. Each drive belt may comprise sub-belts as discussed above. Using a plurality of drive belts (e.g. two) may increase the load capacity of the escalator and/or provide redundancy in case of damage or breakage to one of the drive belts. When a plurality of drive belts is used, it is beneficial for the drive belts to be arranged to provide a symmetric drive force to each step. For example, the escalator may comprise a first drive belt connected towards one side of the plurality of steps and a second drive belt connected towards the other side of the plurality of the plurality of steps.

In examples featuring a plurality of drive belts, the escalator may also comprise a corresponding plurality of belt support structures arranged, i.e. one on each side of an escalator truss to support drive belts on each side of escalator steps. Alternatively, a single belt support structure may provide support to the plurality of drive belts (e.g. comprising a common frame on which a plurality of belt wheels or sets of coplanar belt wheels are provided, with each belt wheel or set of coplanar belt wheels arranged to provide support to a different belt of the plurality of belts.

The use of a support belt for providing support to a drive belt of an escalator is believed to be independently inventive. According to a second aspect of the present disclosure, therefore, there is provided a belt support structure for supporting an escalator drive belt, the belt support structure comprising a plurality of support wheels and a support belt extending over the plurality of support wheels, wherein the support belt is arranged to provide support to the drive belt.

In some examples, the support belt comprises a lower surface in contact with the support wheels and comprising at least one longitudinal groove (e.g. a "v" shaped groove). In such examples, at least one of the support wheels over which the support belt extends may comprise a corresponding ridge arranged to engage with the groove to guide the support belt and keep it in the correct position. In some sets of examples, the support belt comprises a poly-v belt (i.e. a flat belt comprising several adjacent "v" shaped grooves). In such examples, at least one of the support wheels may comprise a corresponding plurality of ridges. Of course, in some examples, the support belt may comprise at least one longitudinal ridge (or a plurality of adjacent ridges) and at least one support wheel may comprise a corresponding groove (or a plurality of grooves) arranged to engage with the ridge(s).

The plurality of support wheels may all be of the same or similar type (e.g. comprising the same or similar material(s) and/or having the same or similar dimensions). However, in some examples the plurality of support wheels may comprise two or more types of support wheels. For example, the belt support structure may comprise two terminal support wheels between which the support belt extends, along with one or more intermediate support wheels located between the two terminal support wheels. In such examples, the terminal support wheels may hold the belt in tension whilst the intermediate support wheels simply provide upwards support to the support belt. The terminal support wheels may have a larger radius than the intermediate support wheels, to increase the radius of curvature of, and thus reduce localised stresses on, the support belt as it passes around them. In examples featuring a grooved or poly-v support belt, one or more of the terminal support wheels may comprise a corresponding ridge or groove or plurality of ridges or grooves to help to guide the support belt. In some examples the belt support structure may comprise at least three, or even at least five intermediate support wheels.

The belt support structure may be arranged to provide curved support to the escalator drive belt. For example, the plurality of support wheels over which the support belt extends may comprise at least three coplanar support wheels arranged in a curve.

Features of any aspect or example described herein may, wherever appropriate, be applied to any other aspect or example described herein. Where reference is made to different examples, it should be understood that these are not necessarily distinct but may overlap. It will be appreciated that all of the preferred or optional features of the belt-driven escalator according to the first aspect described above may, where appropriate, also apply to the other aspects of the disclosure.

DRAWING DESCRIPTION

Certain examples of the present disclosure will now be described with reference to the accompanying drawings in which.

DETAILED DESCRIPTION

Figure 1:
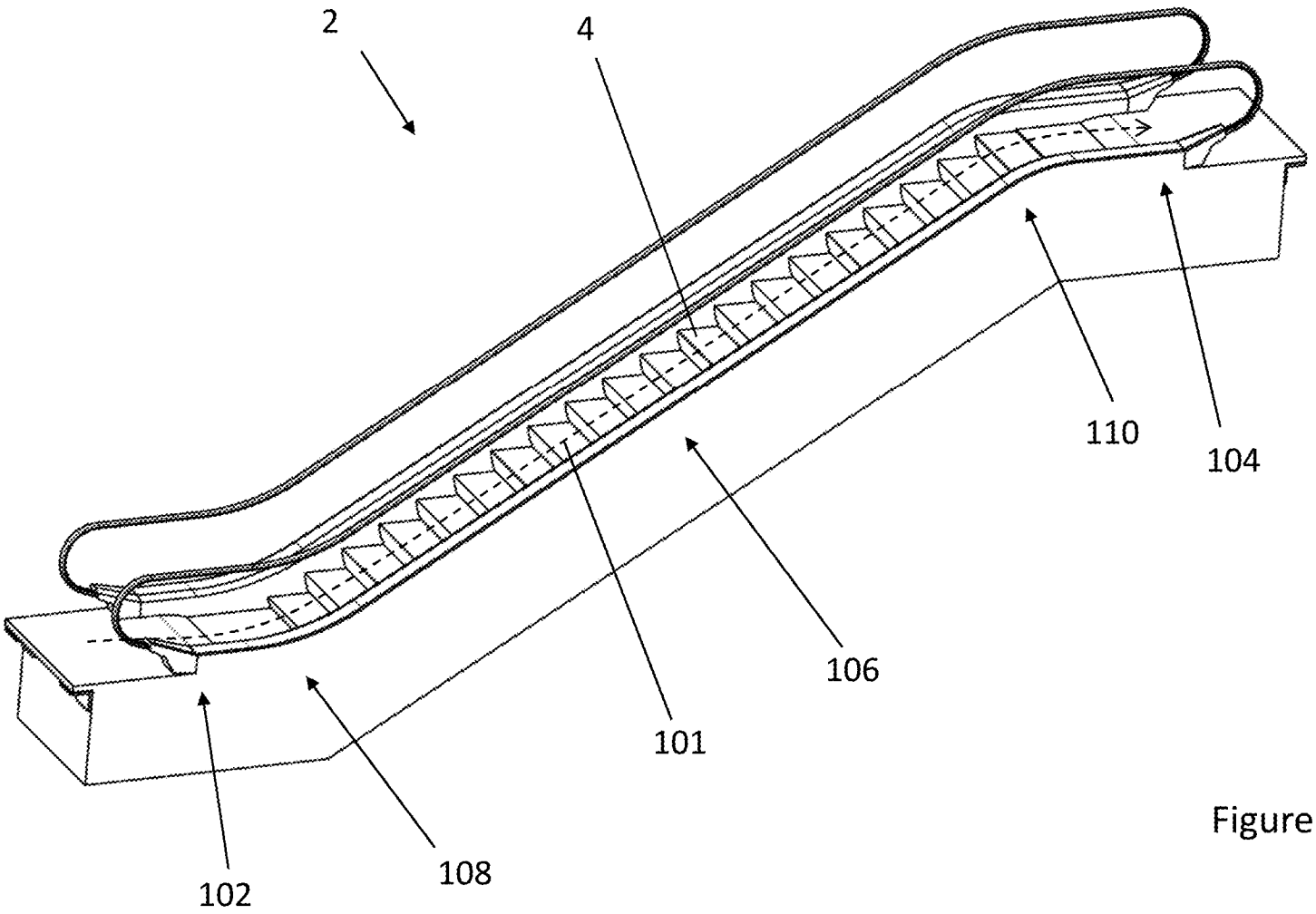
FIG. 1 shows a belt driven escalator according to an example of the present disclosure.

FIG. 1 shows a belt driven escalator 2 comprising a plurality of escalator steps 4 arranged to travel along an escalator conveyance path 101 to convey passengers. The conveyance path 101 comprises a lower landing region 102, an upper landing region 104 and an inclined region 106 located between the landing regions 102, 104. The conveyance path 101 comprises a lower transition region 108 between the inclined region 106 and the lower landing region 102 and an upper transition region 110 between the inclined region 106 and the upper landing region 104. In the upper transition region 110, the steps 4 transition from travelling at an incline in the inclined region 106 to travelling parallel to the ground in the non-inclined upper landing region 104.

Figure 2:
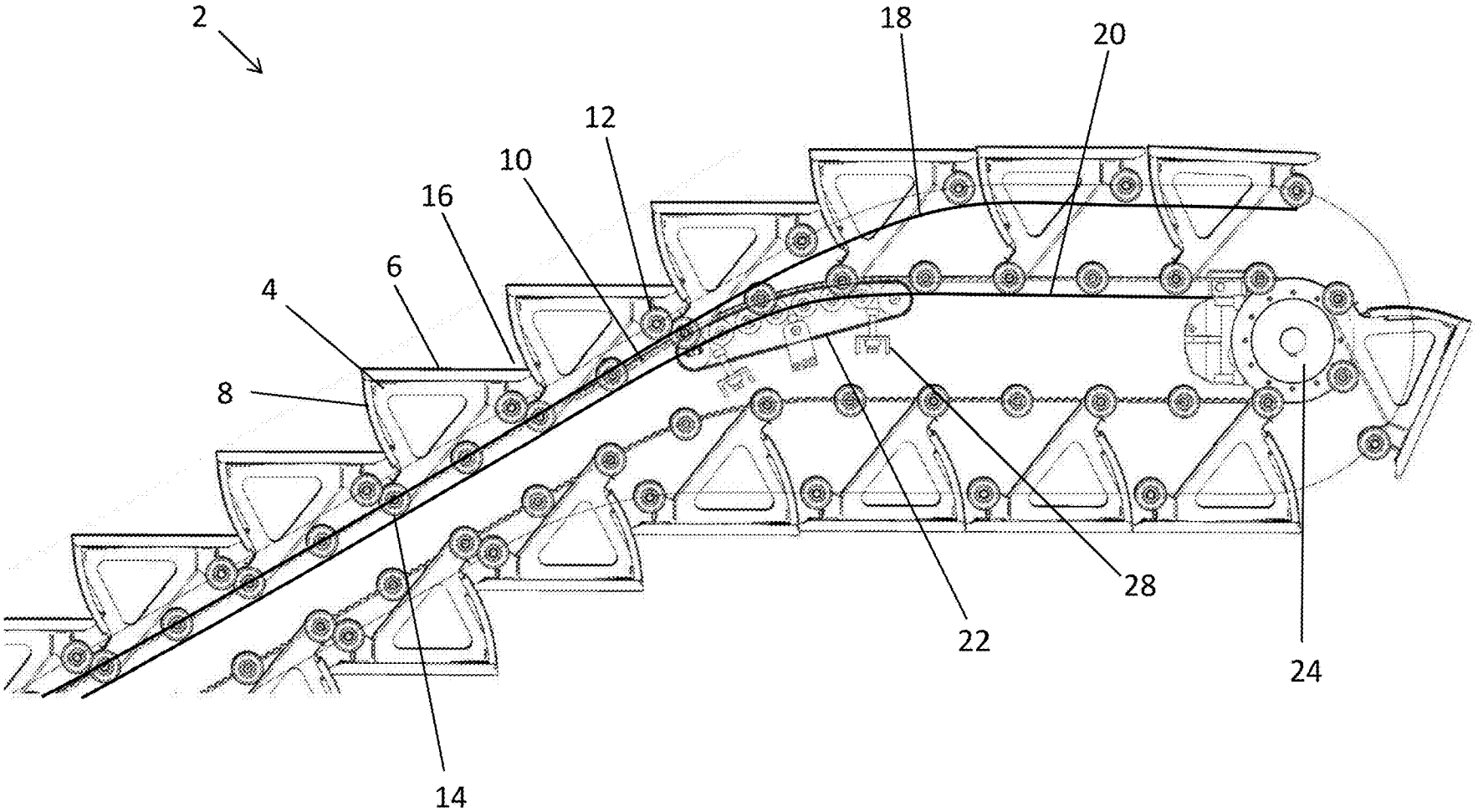
FIG. 2 is a partial cross-section view of an upper section of the belt driven escalator.
Figure 3:
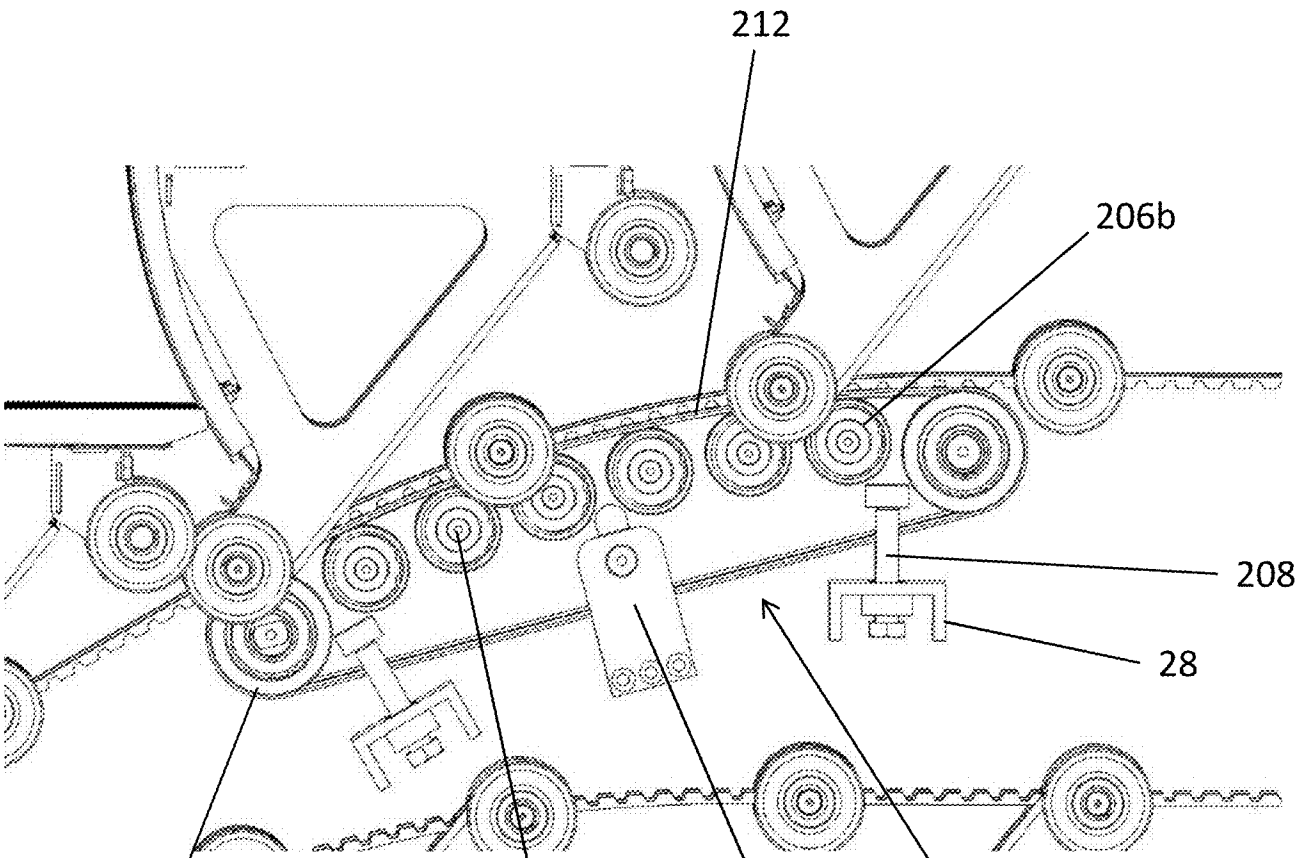
FIG. 3 is a close up partial cross-section view of the belt driven escalator.
Figure 4:
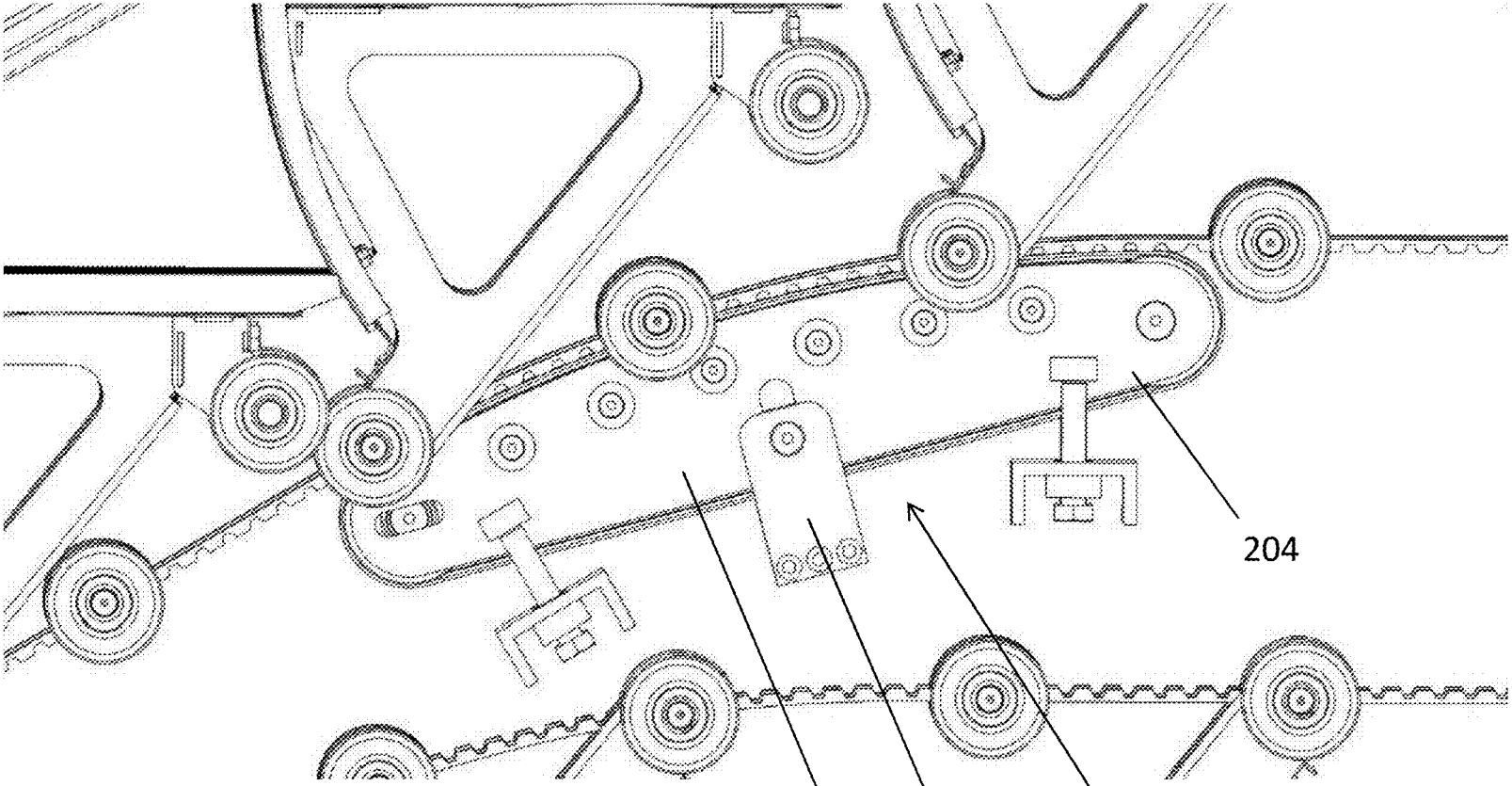
FIG. 4 is another close up partial cross-section view of the belt driven escalator.
Figure 5:
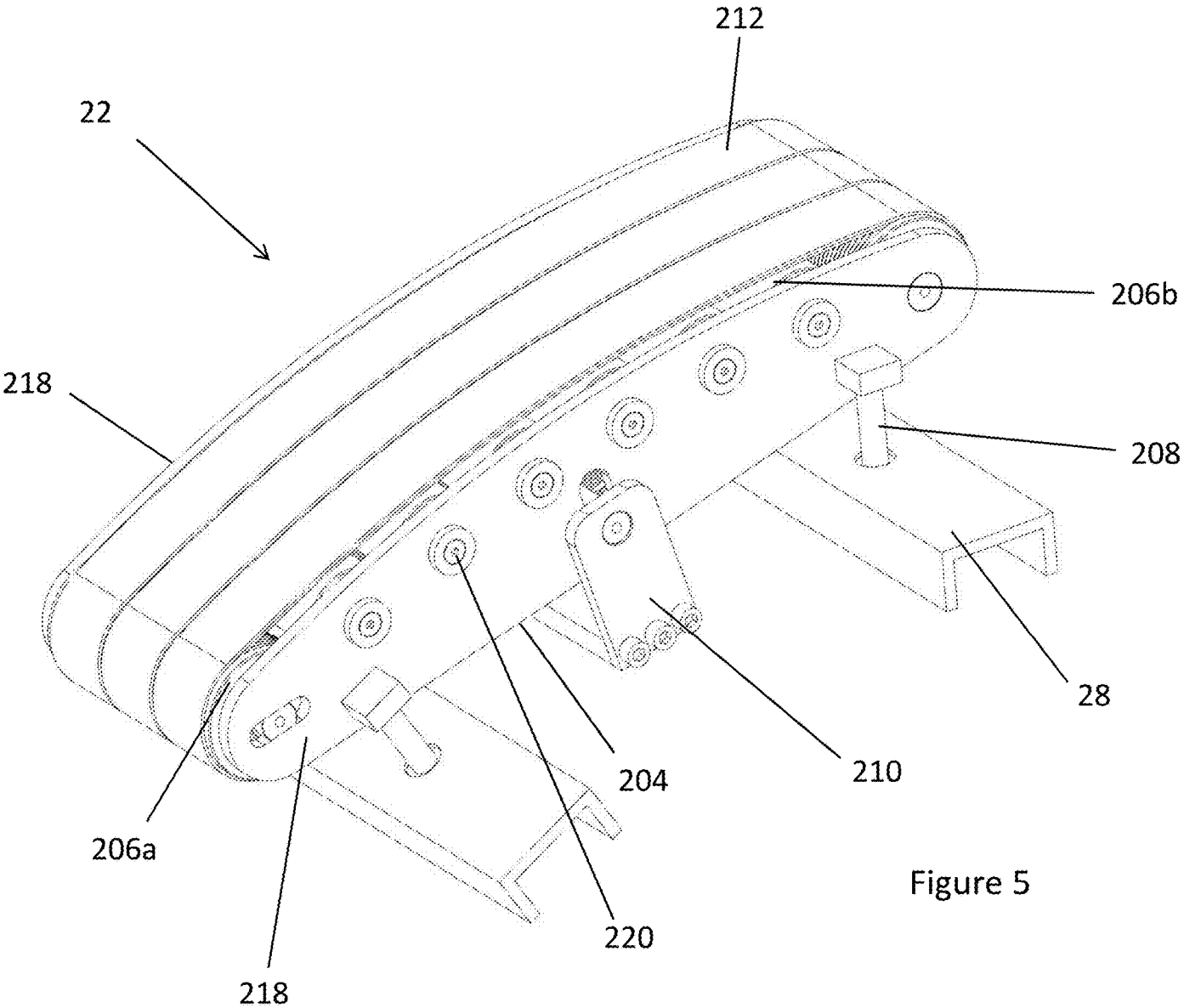
FIG. 5 shows the belt support structure of the escalator shown in FIGS. 2-4.
Figure 6:
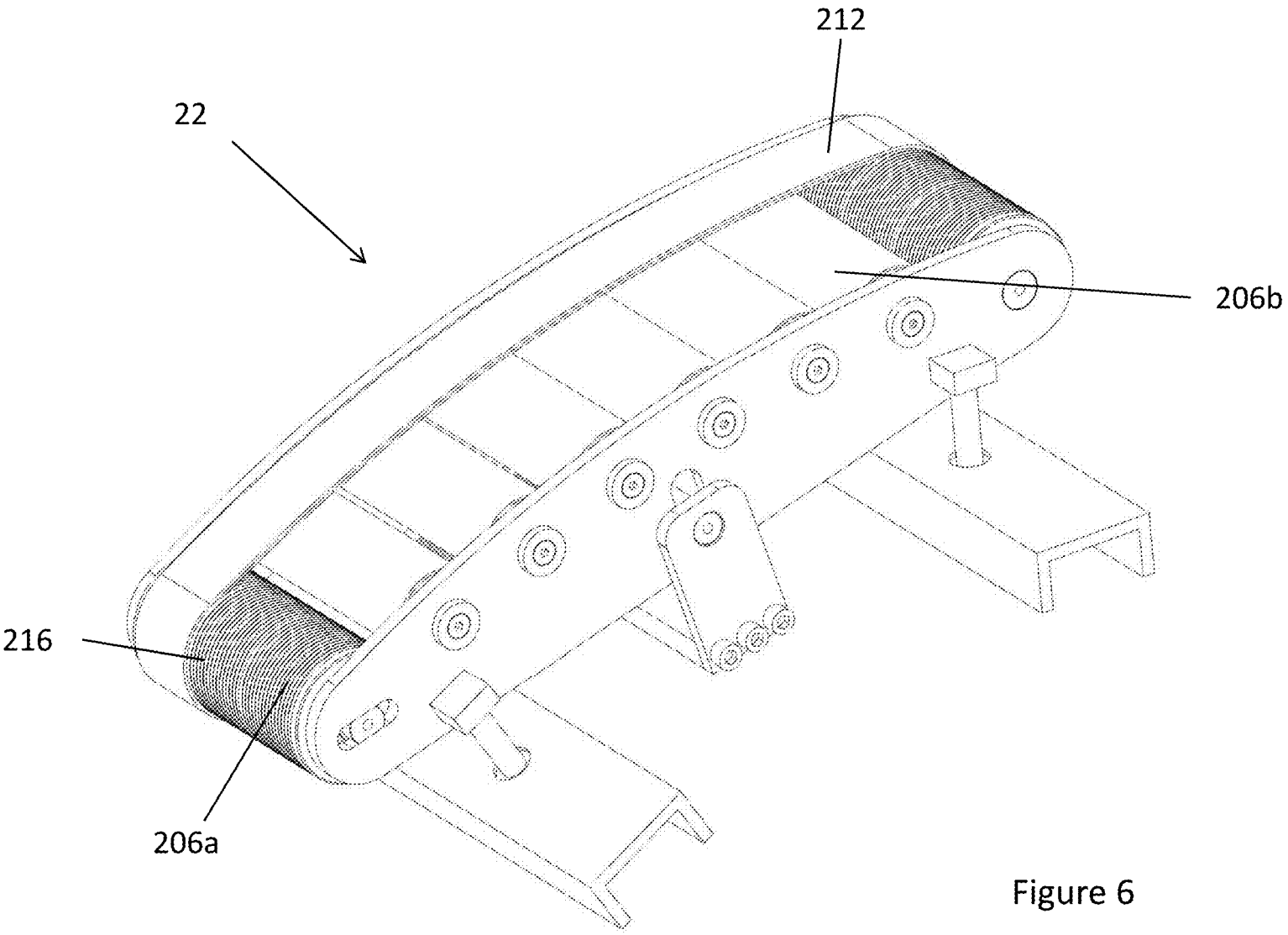
FIGS. 6 and 7 are partial views of the belt support structure shown in FIG. 5.
Figure 7:
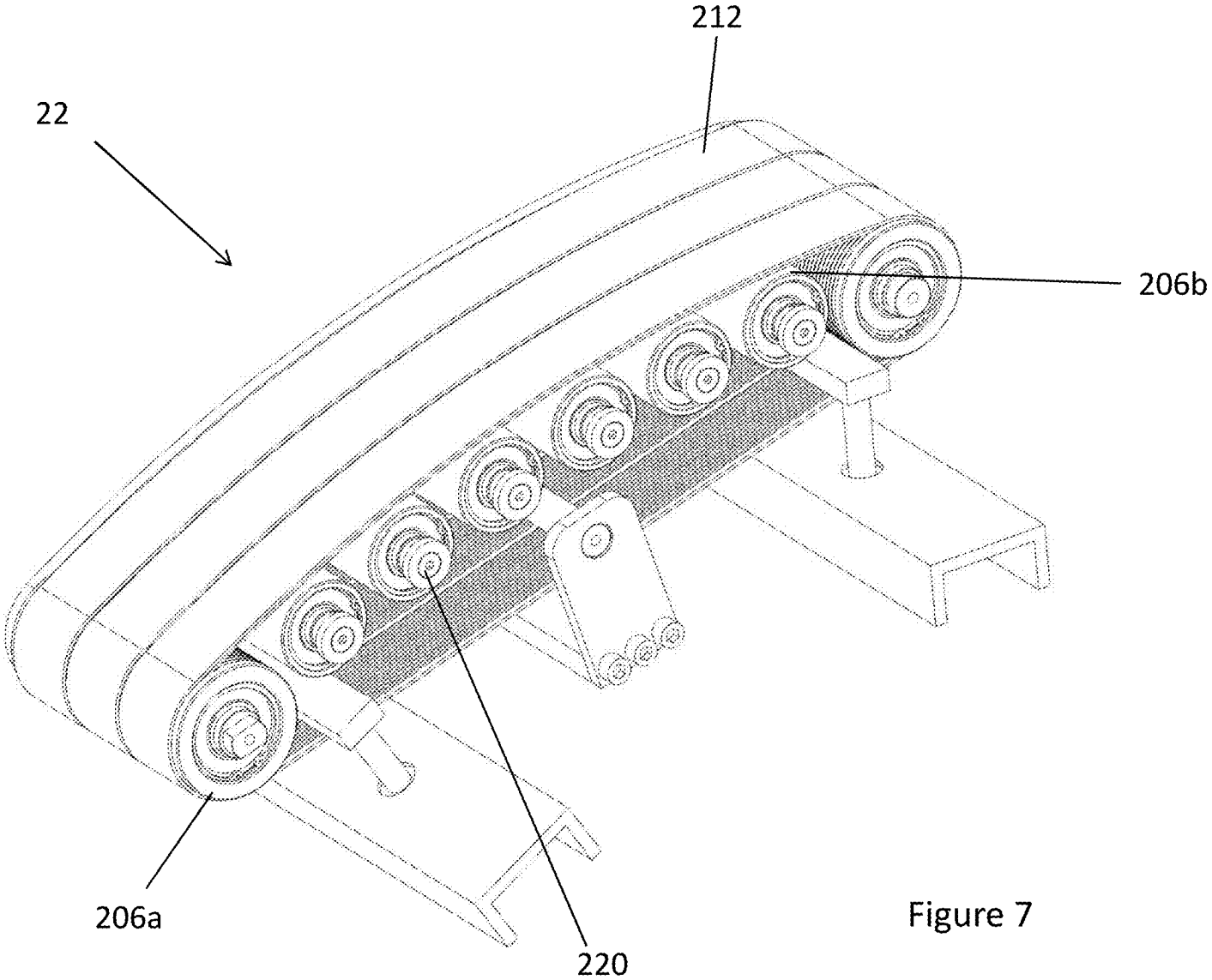
Figure 8:
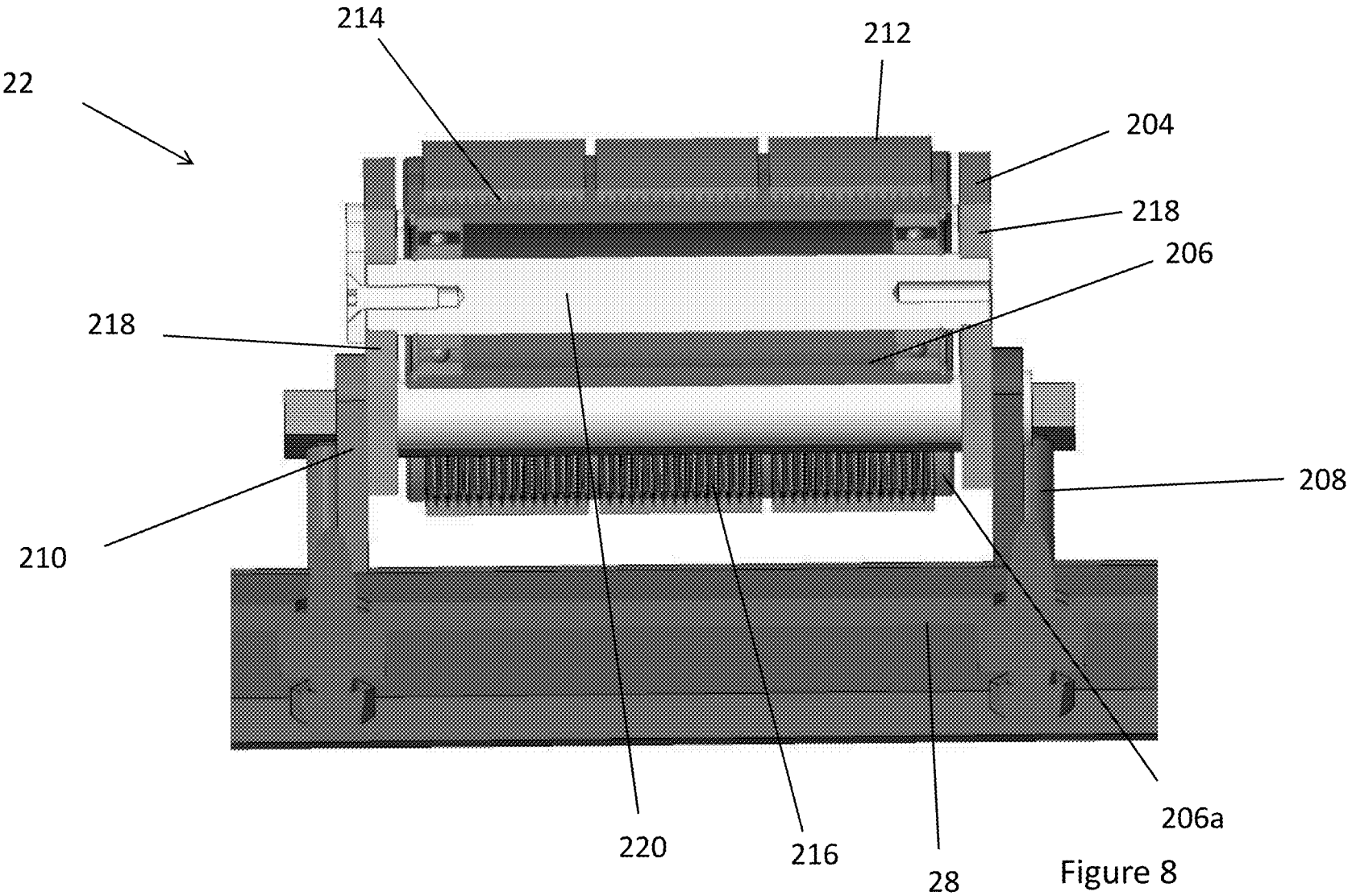
FIG. 8 is a cross section view of the belt support structure shown in FIGS. 5-7.

FIG. 2 is a partial side view of the escalator 2 in the upper transition region 110. Each step 4 comprises a tread surface 6 and a front surface 8. Each step 4 is rotatably connected to a drive belt 10. The drive belt 10 is driven by a drive system 24 to propel the plurality of escalator steps 4 along the conveyance path 101.

Each escalator step 4 comprises a pair of step rollers 12 and a pair of support rollers 14. The tread surface 6 extends from the front surface 8 to a rear edge 16. The step rollers 12 are connected to the step 4 near the rear edge 16, with one step roller 12 at each side of the rear edge 16. The support rollers 14 are connected to the step 4 near the bottom of the front surface 8, with one support roller 14 on each side of each step 4. The drive belt 10 is connected to each step 4 such that the axes of rotation of the support rollers 14 pass through the drive belt 10 when it is connected, to reduce the application of off-axis forces (i.e. a moment) to the support rollers 14.

As the steps are propelled along the conveyance path 101, the step rollers 12 travel along two parallel step tracks 18 and the support rollers 14 travel along two parallel support tracks 20 that are rigidly fixed to a truss 28 that provides the overall structure to the escalator 2. The step tracks 18 and support tracks 20 are arranged such that the tread surface 6 of each step 4 remains horizontal (i.e. parallel to the ground) throughout passenger conveyance. For example, in the curved upper and lower transition regions 108, 110 the step tracks 18 and support tracks 20 diverge from one another and are similarly curved to keep the steps 4 level.

As mentioned above, in the upper transition region 110 the steps 4 transition from travelling at an incline to travelling parallel to the ground (when the escalator 2 is operated in an upwards direction; an opposite transition occurs when the escalator 2 is driven in a downwards direction). The tension force in the drive belt 10 in the upper transition region 110 thus has a component which urges the steps 4 (via the support rollers 14) into the support tracks 20. It will be appreciated that in other examples in which the belt 10 is connected to a different location on the step 4, the tension forces may be applied through the step rollers 12 against the step tracks 18 or indeed through both the step rollers 12 and the support rollers 14 against both the step tracks 18 and support tracks 20.

The step tracks 18 and support tracks 20 (and the step rollers 12 and support rollers 14) could simply be engineered to be strong enough to withstand this additional force in the upper transition region 110. However, this would either cause them to be unnecessarily strong in other regions, or require them to have a complex structure with different levels of strength in different regions. Instead, in this example the escalator 2 comprises a belt support structure 22 in the upper transition region 110 that is arranged to support the escalator steps 4 via the drive belt 10. The belt support structure 22 is arranged to at least partially unload the support tracks 20 (and consequently the support rollers 14) in the upper transition region 110, and may even be arranged to fully unload, i.e. entirely lift the support rollers 14 away from the support tracks 20 in the transition region. The support rollers 14 and support tracks 20 may thus be designed to provide only the support required in other regions of the conveyance path 101, with the belt support structure 22 providing additional support in the upper transition region 110. As discussed above, sections of the support tracks 20 may be omitted in the region where full support is provided by the belt support structure 22. Again, it will be appreciated that in other examples where the belt connection is made to a different part of the step 4, the support provided by the belt support structure 22 may instead partially or fully lift the step rollers 12 from the step tracks 18 or may partially or fully lift both sets of rollers 12, 14 from both tracks 18, 20.

The belt support structure 22, which is shown in more detail in FIGS. 3-8, comprises a frame 204 (shown in FIGS. 4-6) to which a plurality of coplanar support wheels 206 is mounted (reference number 206 encompassing both reference numbers 206*a* and 206*b* discussed further below). The frame 204 is in turn mounted to the truss 28 of the escalator 2 via four screw-adjustable fittings 208 and a retaining member 210. The screw-adjustable fittings 208 enable the position and orientation of the frame 204 relative to the truss 28 to be adjusted. In this example, the frame 204 simply rests on top of the screw-adjustable fittings 208 but is retained from moving laterally or in the direction of travel of the drive belt 10 by the retaining member 210.

The plurality of support wheels 206 comprises two larger terminal support wheels 206*a* at either end of the frame and six smaller intermediate support wheels 206*b* in between the terminal support wheels 206*a*. Three adjacent support belts 212 extend over and around the support wheels 206. Each support belt 212 comprises a poly-v belt comprising a series of adjacent grooves 214 (shown best in FIG. 8) and the terminal support wheels 206*a* each comprise a corresponding series of adjacent ridges 216 (indicated in FIG. 6), to help guide the support belts 212.

The frame 204 comprises two outer plates 218 to which the plurality of support wheels 206 is mounted via a plurality of axles 220. One of the plates 218 (the plate primarily visible in FIG. 3) is held in place by the retaining member 210. Over the life of the escalator, it may be necessary to repair or replace one or more of the support belts 212. The structure and arrangement of the belt support structure 22 facilitates this. To remove and replace a support belt 212, only the retaining member 210 and one plate 218 need to be removed, without needing to disassemble the whole belt support structure 22 or remove it from the escalator 2. One of the terminal support wheels 206*a* is adjustably mounted to the outer plates 218, allowing the tension in the support belts 212 to be adjusted. The support belt (or belts) 212 that need to be replaced can be slid off the side of the belt support structure 22 where the plate 218 has been removed. These old support belts 22 can then be fully separated from the escalator 2 simply by lifting the belt support structure 22 off the screw-adjustable fittings 208 far enough to allow the old belt to pass between the screw-adjustable fittings 208 and the belt support structure 22. New support belts 212 can be installed using the reverse procedure.

Figure 9:
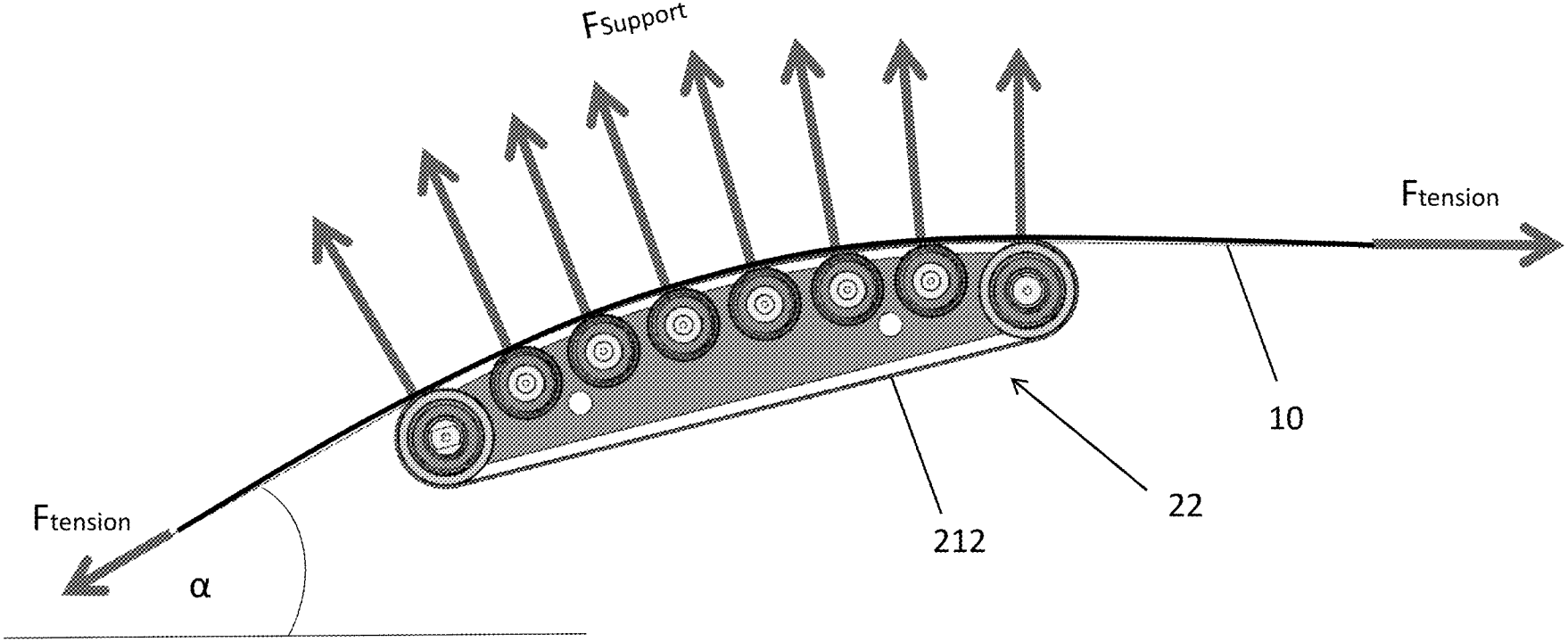
FIG. 9 is a schematic diagram of forces acting on the belt-support structure in use.

As best shown in FIG. 9, the support belts 212 provide support force $F_{support}$ to the drive belt 10 along a smooth curve that matches the curve of the upper transition region 110. This provides the increased support needed in the upper transition region 110 arising from the tension force $F_{tension}$ in the drive belt 10 and the incline angle $\alpha$ of the escalator 2, without the support rollers 14 needing to be in contact with the support tracks 20 in this region. Accordingly, the steps 4 are maintained in their appropriate horizontal orientation as required. The use of the support belts 212 means that the support is provided along a smooth curve, increasing passenger comfort and reducing stresses in the drive belt 10.

Figure 10:
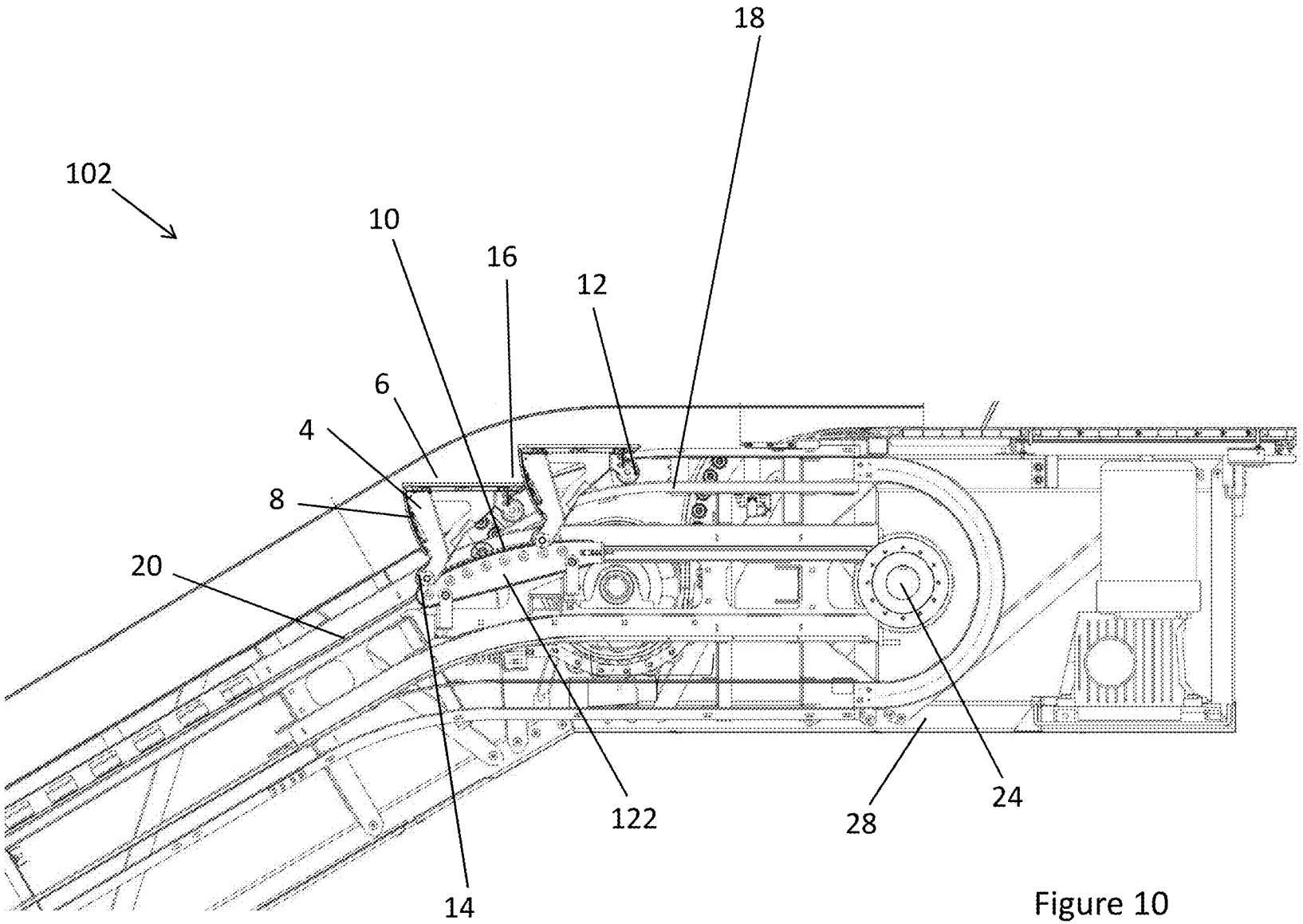
FIG. 10 is a partial cross-section view of an upper section of a belt driven escalator according to another example of the present disclosure.
Figure 11:
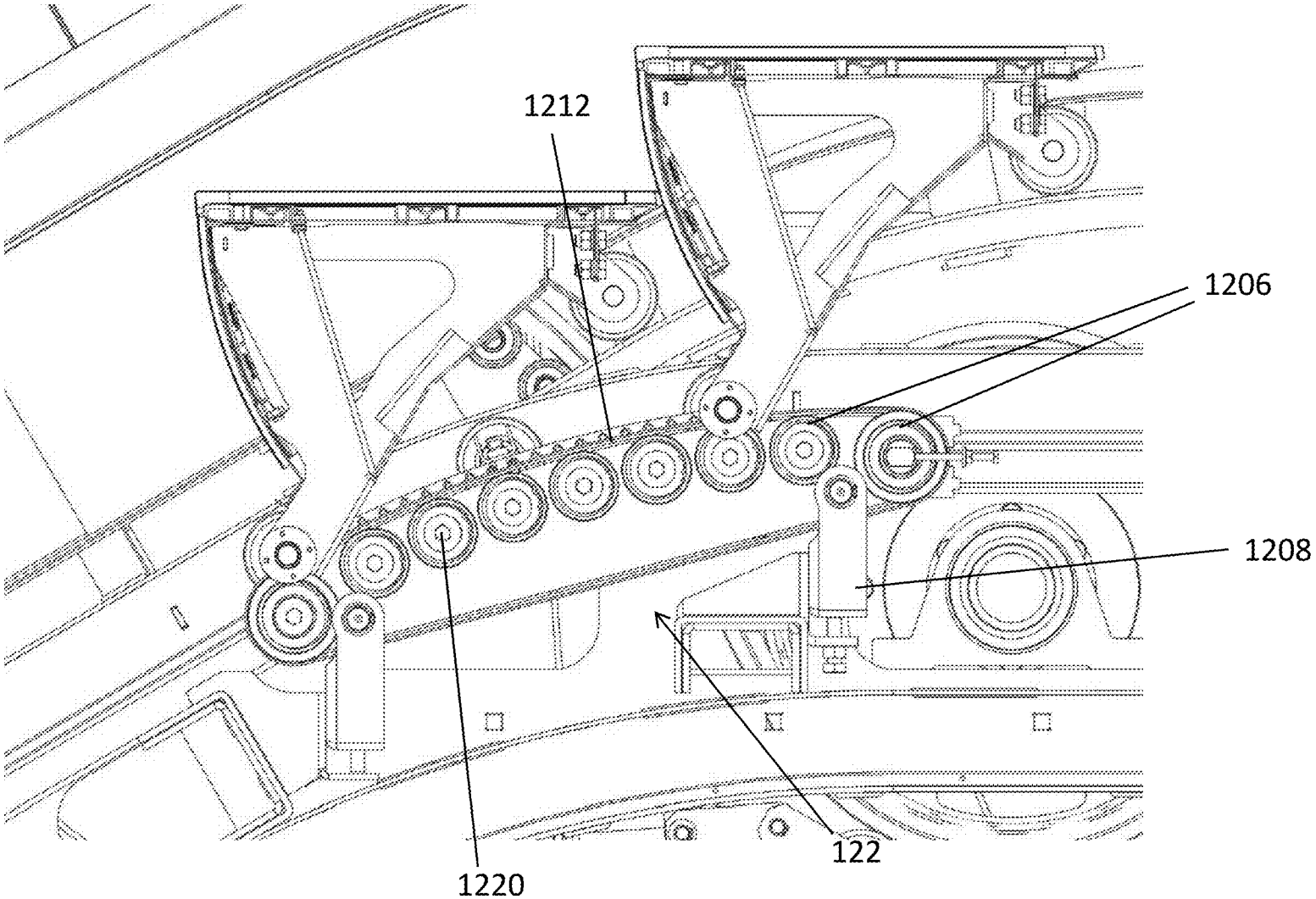
FIG. 11 is a close-up partial cross-section view of the belt driven escalator of FIG. 10.
Figure 12:
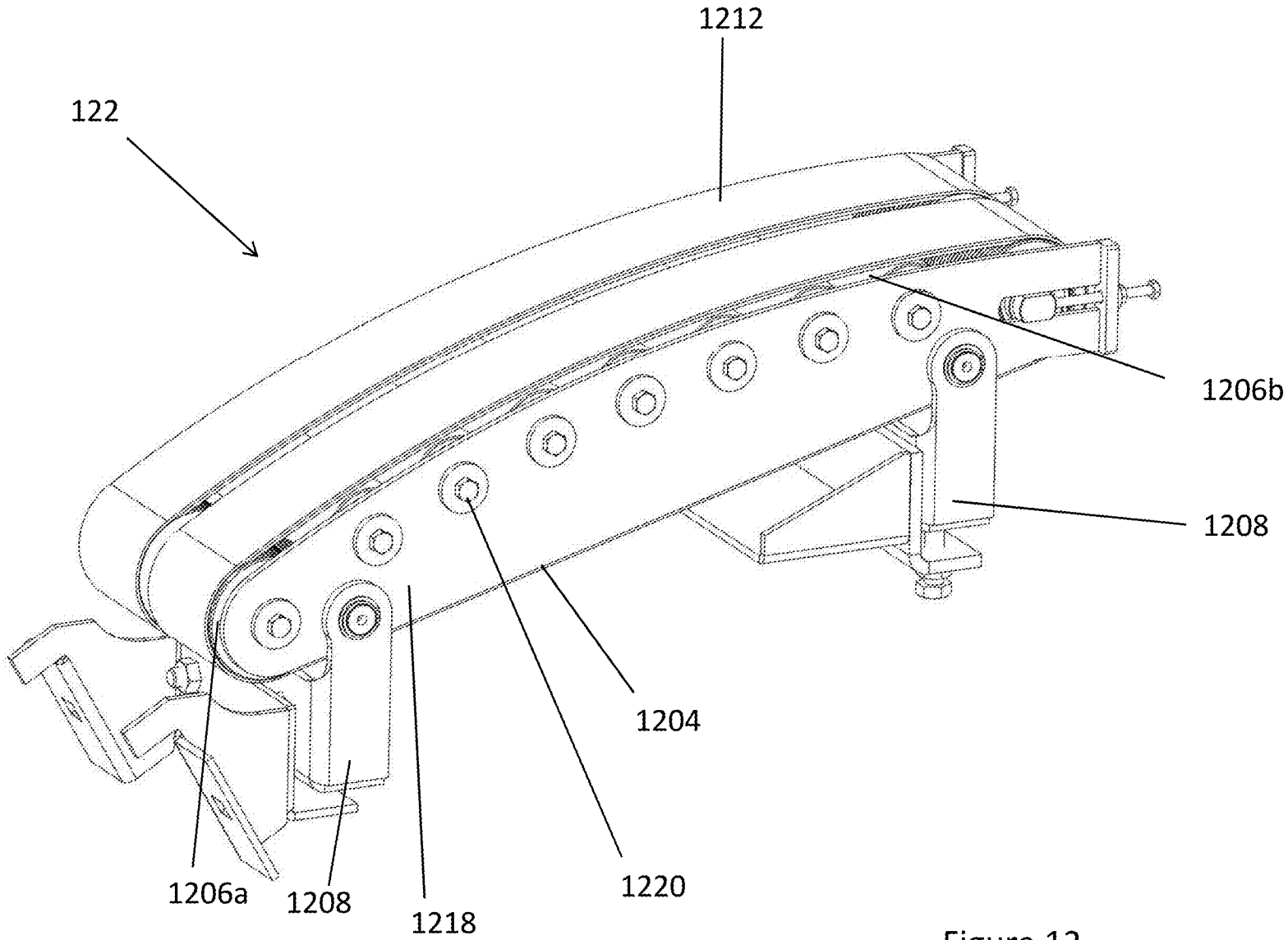
FIG. 12 shows the belt support structure of the belt driven escalator of FIGS. 10 and 11.
Figure 13:
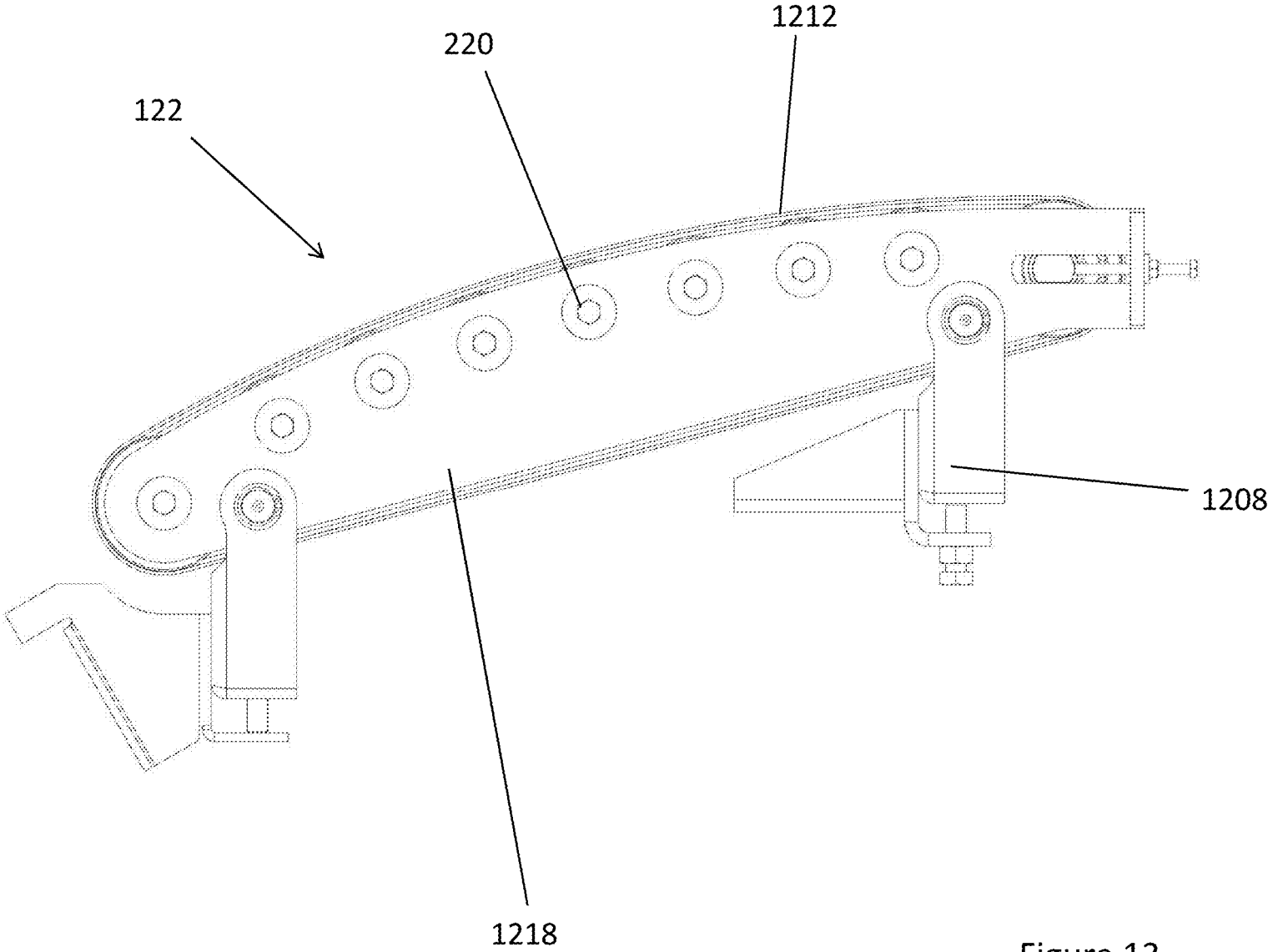
FIG. 13 is a side view of the belt support structure of FIGS. 10 to 12.
Figure 14:
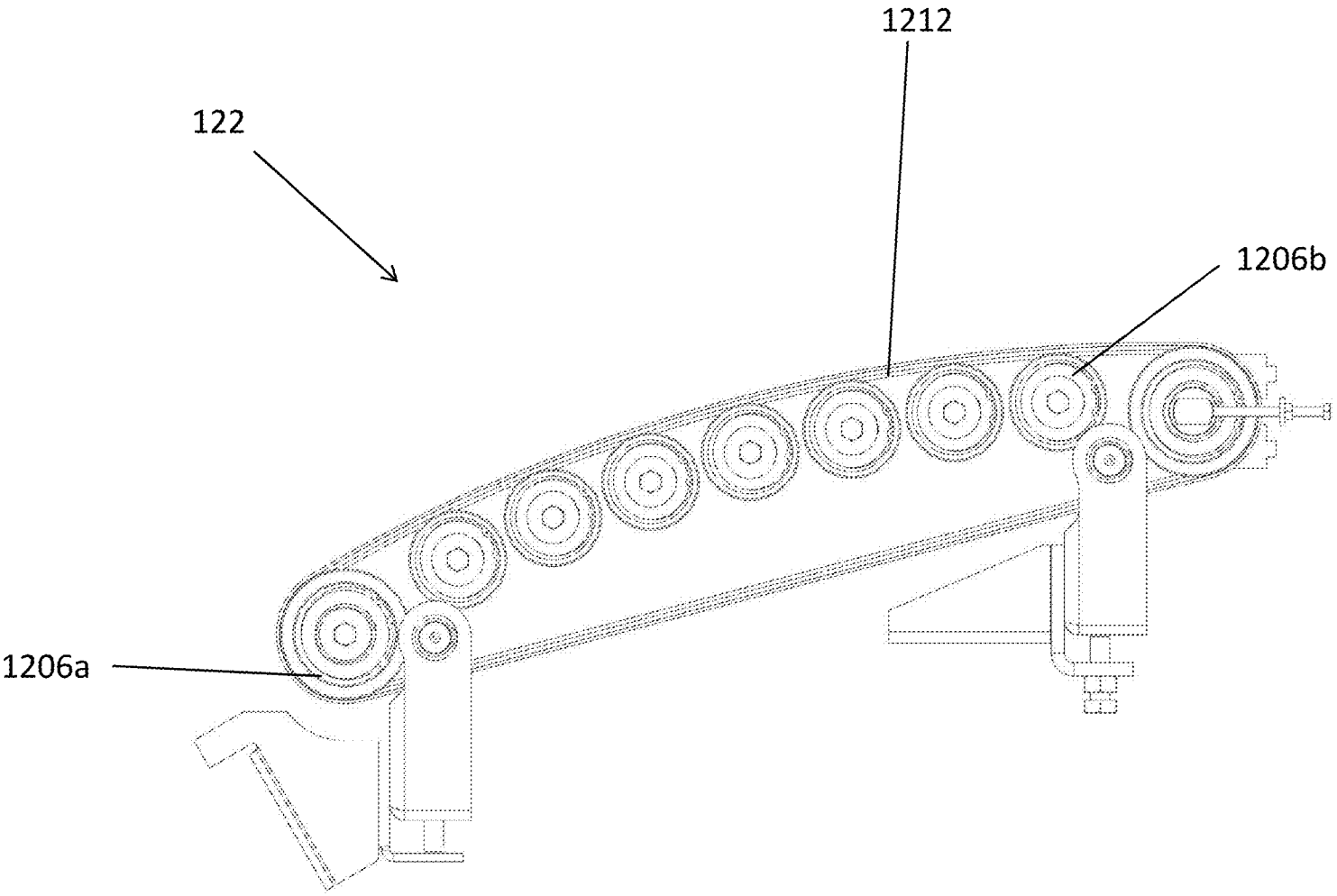
FIG. 14 is a side view of the belt support structure of FIGS. 10 to 12 with one side plate removed.

FIG. 10 is a partial side view of an upper transition region of another belt driven escalator 102 with a similar general structure to the escalator 2 described above with reference to FIGS. 1-9.

However, the escalator 102 comprises a different example of a belt support structure 122 that is arranged to support the escalator steps 4 via the drive belt 10.

The belt support structure 122, which is shown in more detail in FIGS. 11-18, comprises a frame 1204 to which a plurality of coplanar support wheels 1206 (encompassing 1206*a* and 1206*b*) is mounted. The frame 1204 is, in turn, mounted to the truss 28 of the escalator 102 via two adjustable fittings 1208. The adjustable fittings 1208 enable the position and orientation of the belt support structure 122 relative to the truss 28 to be adjusted.

The plurality of support wheels 1206 comprises two larger terminal support wheels 1206*a* at either end of the frame 1204 and seven smaller intermediate support wheels 1206*b* in between the terminal support wheels 1206*a*. Two adjacent support belts 1212 extend over and around the support wheels 1206. Each support belt 1212 comprises a poly-v belt comprising a series of adjacent grooves 1214 (shown best in FIGS. 15 and 16) and the terminal support wheels 1206*a* each comprise a corresponding series of adjacent ridges 1216, to cooperate with the grooves 1214 and help guide the support belts 1212.

The frame 1204 comprises two outer plates 1218 to which the plurality of support wheels 1206 is mounted via a plurality of axles 1220. One of the terminal support wheels 1206*a* (the righthand one in FIG. 12) is adjustably mounted to the outer plates 1218, allowing the tension in the support belts 1212 to be adjusted.

Figure 15:
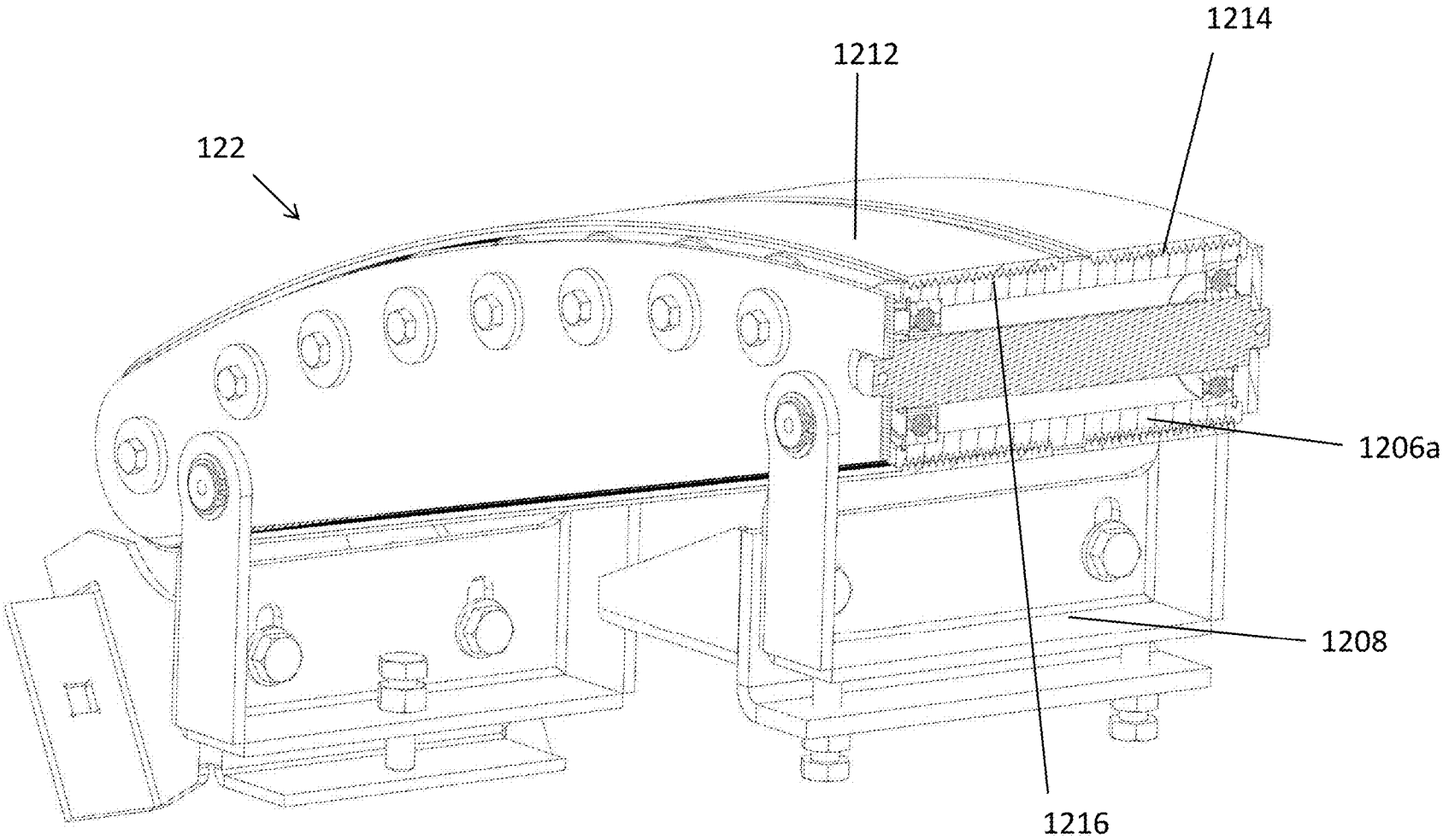
FIGS. 15 and 16 show cross-sections through a terminal support wheel and support belt of the belt support structure of FIGS. 10 to 14.
Figure 16:
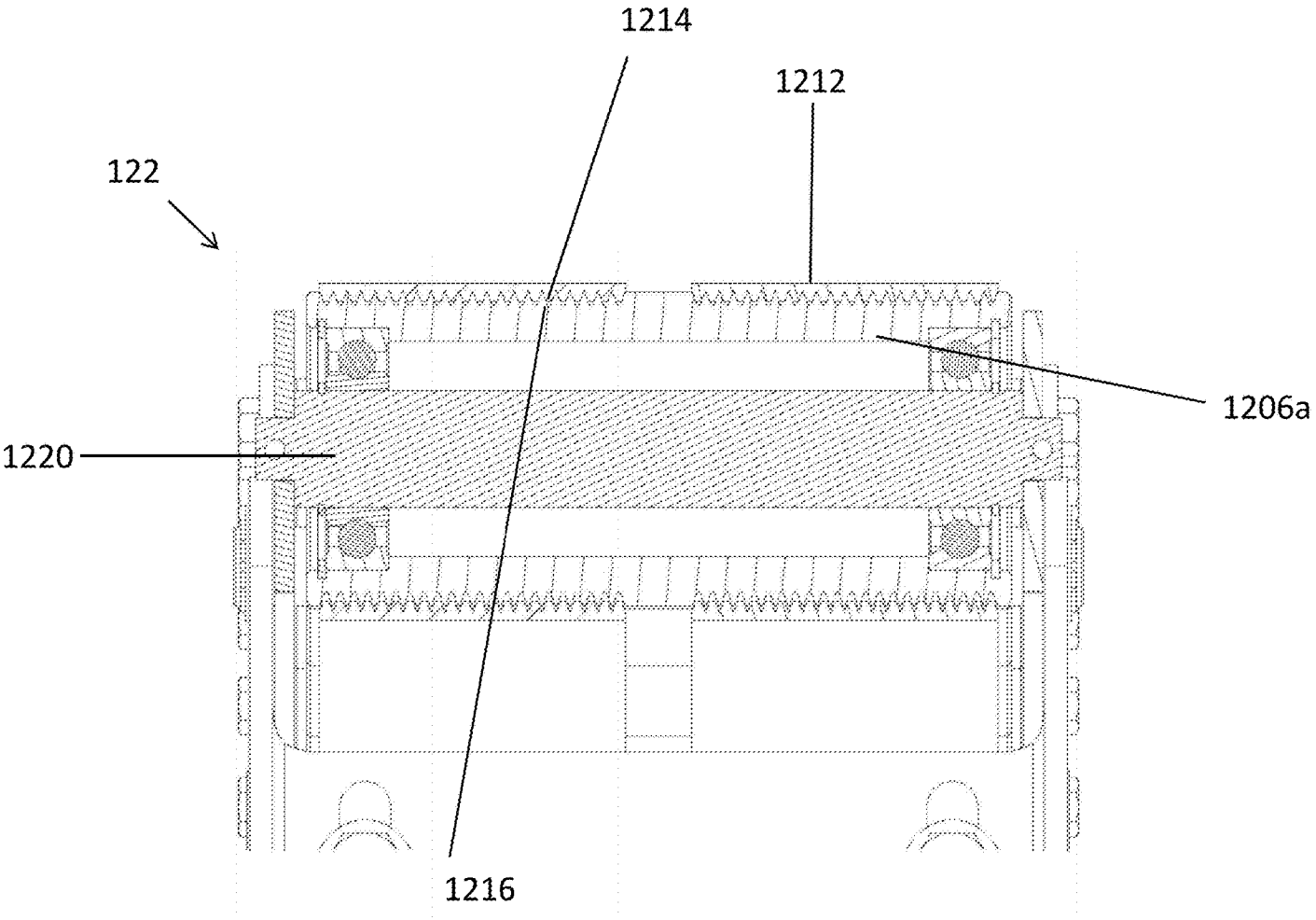
Figure 17:
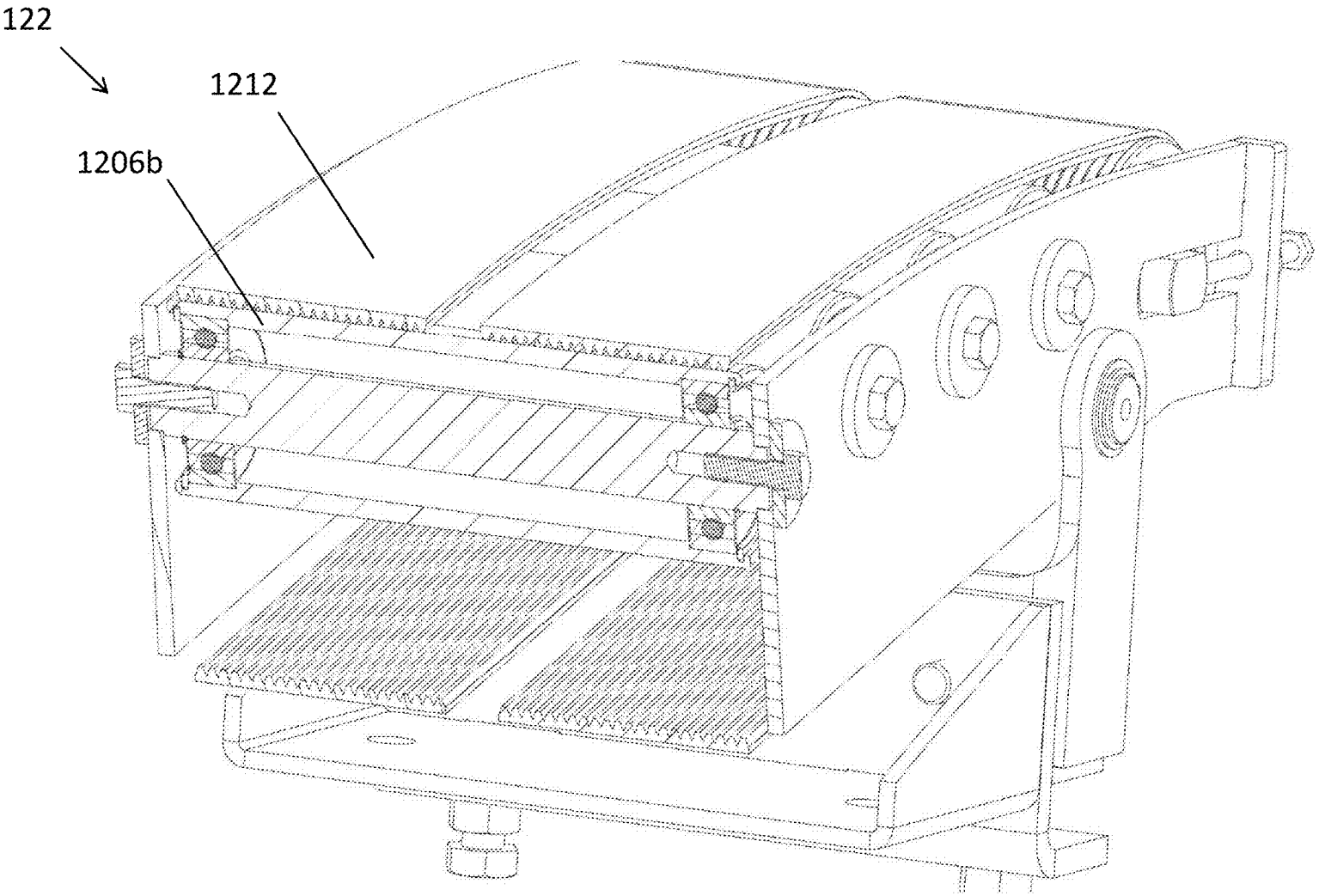
FIGS. 17 and 18 show cross-sections through an intermediate support wheel and support belt of the belt support structure of FIGS. 10 to 16.
Figure 18:
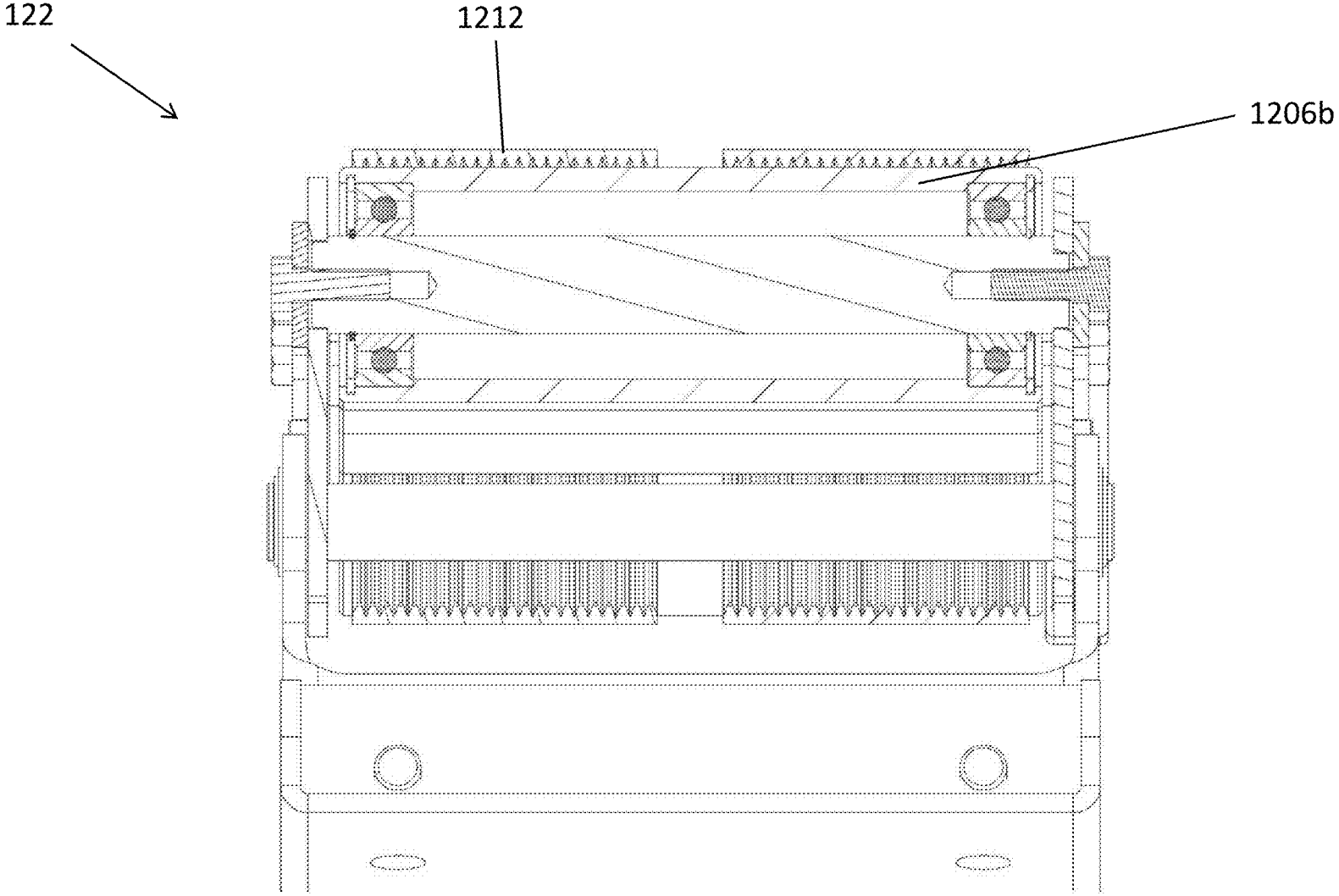

FIGS. 15 and 16 show cross-sections through a terminal support wheel 1206*a* and the support belt 1212 and showing how the ridges 1216 of the terminal support wheel 1206*a* cooperate with the grooves 1214 of the support belt 1212. FIGS. 17 and 18 show cross-sections through an intermediate support wheel 1206*b* and show that the intermediate support wheel 1206*b* has a smooth (no grooves or ridges) outer surface that provides support to the support belt 1212. No additional grooves or ridges are needed on these intermediate support wheels 1206*b* as sufficient guidance is provided by the terminal support wheels 1206*a*. This allows the intermediate support wheels 1206*b* to be simpler and less expensive. It will be appreciated that while this structure of FIGS. 15-18 has been shown in relation to the example of FIGS. 10-14, it applies equally to the example of FIGS. 1-9 as well.

While the disclosure has been described in detail in connection with only a limited number of examples, it should be readily understood that the disclosure is not limited to such disclosed examples. Rather, the disclosure can be modified to incorporate any number of variations, alterations, substitutions or equivalent arrangements not heretofore described, but which are commensurate with the scope of the disclosure. Additionally, while various examples of the disclosure have been described, it is to be understood that aspects of the disclosure may include only some of the described examples. Accordingly, the disclosure is not to be seen as limited by the foregoing description, but is only limited by the scope of the appended claims.

What is claimed is:

1. A belt-driven escalator (2) comprising:

a plurality of escalator steps (4) arranged to travel along an inclined conveyance path (101);

a drive belt (10) directly and rotatably connected to the plurality of escalator steps (4);

a drive system (24) arranged to drive the drive belt (10) so as to propel the plurality of escalator steps (4) along the inclined conveyance path (101); and a belt support structure (22) comprising a plurality of support wheels (206) and a support belt (212) extending over the plurality of support wheels (206), wherein the support belt (212) is arranged to provide support to the plurality of escalator steps (4) via the drive belt (10).

2. The belt-driven escalator (2) as claimed in claim 1, wherein the conveyance path (101) comprises an upper transition region (110) between an inclined region (106) and a non-inclined landing region (104), and the belt support structure (22) is arranged to provide support to the steps (4) in the upper transition region (110).

3. The belt-driven escalator (2) as claimed in claim 2, wherein the support belt (212) is arranged to provide curved support to the drive belt (10) in the upper transition region (110).

4. The belt-driven escalator (2) as claimed in claim 3, wherein the belt support structure (22) is arranged to provide curved support to the drive belt (10) with a curve that matches a curve of the upper transition region (110).

5. The belt-driven escalator (2) as claimed in claim 1, wherein the plurality of support wheels (206) over which the support belt (212) extends comprises at least three coplanar support wheels (206) arranged in a curve.

6. The belt-driven escalator (2) as claimed in claim 1, wherein the drive belt (10) is toothed.

7. The belt-driven escalator (2) as claimed in claim 1, wherein the belt support structure (22) comprises a frame (204) to which the plurality of support wheels (206) is mounted.

8. The belt-driven escalator (2) as claimed in claim 7, wherein the belt support structure (22) comprises one or more removable mounting structures (218) via which one or more support wheels (206) is mounted to the frame (204).

9. The belt-driven escalator (2) as claimed in claim 1, wherein the belt support structure (22) comprises two terminal support wheels (206*a*) between which the support belt (10) extends, along with one or more intermediate support wheels (206*b*) located between the two terminal support wheels (206*a*).

10. A belt-driven escalator (2) comprising:

a plurality of escalator steps (4) arranged to travel along an inclined conveyance path (101);

a drive belt (10) connected to the plurality of escalator steps (4);

a drive system (24) arranged to drive the drive belt (10) so as to propel the plurality of escalator steps (4) along the inclined conveyance path (101); and a belt support structure (22) comprising a plurality of support wheels (206) and a support belt (212) extending over the plurality of support wheels (206), wherein the support belt (212) is arranged to provide support to the plurality of escalator steps (4) via the drive belt (10);

wherein the belt support structure (22) comprises a frame (204) to which the plurality of support wheels (206) is mounted;

wherein one or more of the plurality of support wheels (206) is adjustably mounted to the frame (204).

11. A belt-driven escalator (2) comprising:

a plurality of escalator steps (4) arranged to travel along an inclined conveyance path (101);

a drive belt (10) connected to the plurality of escalator steps (4);

a drive system (24) arranged to drive the drive belt (10) so as to propel the plurality of escalator steps (4) along the inclined conveyance path (101); and a belt support structure (22) comprising a plurality of support wheels (206) and a support belt (212) extending over the plurality of support wheels (206), wherein the support belt (212) is arranged to provide support to the plurality of escalator steps (4) via the drive belt (10);

wherein the support belt (10) comprises a lower surface in contact with the one or more support wheels (206) and comprising at least one longitudinal groove (214), and at least one of the support wheels (206) over which the support belt (212) extends comprises a corresponding ridge (216) engaged with the at least one longitudinal groove (214).

12. The belt-driven escalator (2) as claimed in claim 11, wherein the support belt (212) comprises a flat belt comprising several adjacent "v" shaped grooves (214), and at least one of the support wheels (206) comprises a corresponding plurality of ridges (216).

13. A belt-driven escalator (2) comprising:

a plurality of escalator steps (4) arranged to travel along an inclined conveyance path (101);

a drive belt (10) connected to the plurality of escalator steps (4);

a drive system (24) arranged to drive the drive belt (10) so as to propel the plurality of escalator steps (4) along the inclined conveyance path (101); and a belt support structure (22) comprising a plurality of support wheels (206) and a support belt (212) extending over the plurality of support wheels (206), wherein the support belt (212) is arranged to provide support to the plurality of escalator steps (4) via the drive belt (10);

wherein the belt support structure (22) comprises a plurality of adjacent support belts (10).

14. A belt support structure (22) for supporting an escalator drive belt (10), the belt support structure (22) comprising a plurality of support wheels (206) and a support belt (212) extending over the plurality of support wheels (206), wherein the support belt (206) is arranged to provide support to the drive belt (10);

wherein the support belt (212) comprises a flat belt comprising several adjacent "v" shaped grooves (214) and at least one of the support wheels (206) comprises a corresponding plurality of ridges (216).

* * * * *